US011694701B2

(12) United States Patent
Dietz et al.

(10) Patent No.: US 11,694,701 B2
(45) **Date of Patent: *Jul. 4, 2023**

(54) LOW-COMPLEXITY TONALITY-ADAPTIVE AUDIO SIGNAL QUANTIZATION

(71) Applicant: Fraunhofer-Gesellschaft zur Foerderung der angewandten Forschung e.V., Munich (DE)

(72) Inventors: Martin Dietz, Nuremberg (DE); Guillaume Fuchs, Bubenrath (DE); Christian Helmrich, Erlangen (DE); Goran Markovic, Nuremberg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 35 days.

This patent is subject to a terminal disclaimer.

(21) Appl. No.: 17/396,526

(22) Filed: Aug. 6, 2021

(65) Prior Publication Data

US 2021/0366499 A1 Nov. 25, 2021

Related U.S. Application Data

(63) Continuation of application No. 16/583,119, filed on Sep. 25, 2019, now Pat. No. 11,094,332, which is a (Continued)

(51) Int. Cl.
*G10L 25/00* (2013.01)
*G10L 19/00* (2013.01)
(Continued)

(52) U.S. Cl.
CPC ..... *G10L 19/035* (2013.01); *G10H 1/06* (2013.01); *G10L 19/0212* (2013.01);
(Continued)

(58) Field of Classification Search
CPC ... G10L 19/0212; G10L 19/035; G10L 25/03; G10L 25/18; G10L 25/21; G10L 25/45;
(Continued)

(56) References Cited

U.S. PATENT DOCUMENTS 5,263,088 A 11/1993 Hazu et al.
5,805,770 A 9/1998 Tsutsui
(Continued)

FOREIGN PATENT DOCUMENTS

CA 2246532 A1 3/2000
CN 1662958 A 8/2005
(Continued)

OTHER PUBLICATIONS

Daudet, Laurent, et al., "MDCT analysis of sinusoids: exact results and applications to coding artifacts reduction", Speech and Audio Processing, IEEE Transactions on, vol. 12, No. 3, pp. 302-312.
(Continued)

*Primary Examiner* — Michael Ortiz-Sanchez
(74) *Attorney, Agent, or Firm* — Perkins Coie LLP; Michael A. Glenn

(57) ABSTRACT

The invention provides an audio encoder for encoding an audio signal so as to produce therefrom an encoded signal, the audio encoder including: a framing device configured to extract frames from the audio signal; a quantizer configured to map spectral lines of a spectrum signal derived from the frame of the audio signal to quantization indices, wherein the quantizer has a dead-zone, in which the input spectral lines are mapped to quantization index zero; and a control device configured to modify the dead-zone; wherein the control device includes a tonality calculating device configured to calculate at least one tonality indicating value for at least one spectrum line or for at least one group of spectral lines, wherein the control device is configured to modify the
(Continued)

dead-zone for the at least one spectrum line or the at least one group of spectrum lines depending on the respective tonality indicating value.

17 Claims, 2 Drawing Sheets

Related U.S. Application Data continuation of application No. 14/812,465, filed on Jul. 29, 2015, now Pat. No. 10,468,043, which is a continuation of application No. PCT/EP2014/051624, filed on Jan. 28, 2014.

(60) Provisional application No. 61/758,191, filed on Jan. 29, 2013.

(51) Int. Cl.

| | |
|---|---|
| ***G10L 19/035*** | (2013.01) |
| ***G10L 19/02*** | (2013.01) |
| ***G10H 1/06*** | (2006.01) |
| ***G10L 25/18*** | (2013.01) |
| ***G10L 25/21*** | (2013.01) |
| ***G10L 25/45*** | (2013.01) |
| *G10L 25/03* | (2013.01) |

(52) U.S. Cl.
CPC ..... *G10L 25/18* (2013.01); *G10L 25/21* (2013.01); *G10L 25/45* (2013.01); *G10H 2210/561* (2013.01); *G10L 25/03* (2013.01)

(58) Field of Classification Search
CPC ..... G10L 19/00; G10L 19/02; G10L 25/15; G10H 1/06; G10H 2210/561
See application file for complete search history.

(56) References Cited

U.S. PATENT DOCUMENTS

| | | | |
|---|---|---|---|
| 5,918,203 | A | 6/1999 | Herre et al. |
| 6,167,093 | A | 12/2000 | Tsutsui et al. |
| 6,301,304 | B1 | 10/2001 | Jing et al. |
| 7,280,700 | B2 | 10/2007 | Tourapis et al. |
| 7,333,930 | B2 | 2/2008 | Baumgarte |
| 7,502,743 | B2 | 3/2009 | Thumpudi et al. |
| 7,738,554 | B2 | 6/2010 | Lin et al. |
| 7,995,649 | B2 | 8/2011 | Zuo et al. |
| 8,655,652 | B2 | 2/2014 | Schug |
| 11,562,754 | B2 * | 1/2023 | Schnell ..... G10L 25/45 |
| 2004/0030548 | A1 | 2/2004 | El-maleh et al. |
| 2005/0252361 | A1 | 11/2005 | Oshikiri |
| 2007/0237236 | A1 | 10/2007 | Chang et al. |
| 2008/0049950 | A1 | 2/2008 | Poletti |
| 2008/0164942 | A1 | 7/2008 | Takeuchi et al. |
| 2008/0240235 | A1 | 10/2008 | Holcomb et al. |
| 2008/0267425 | A1 | 10/2008 | Le Faucheur et al. |
| 2009/0210235 | A1 | 8/2009 | Shirakawa et al. |
| 2011/0173012 | A1 | 7/2011 | Rettelbach et al. |
| 2013/0028426 | A1 | 1/2013 | Purnhagen et al. |
| 2013/0054252 | A1 * | 2/2013 | Tsai ..... G10L 19/008 704/500 |
| 2013/0128957 | A1 | 5/2013 | Bankoski et al. |
| 2016/0027448 | A1 | 1/2016 | Dietz et al. |

FOREIGN PATENT DOCUMENTS

| | | | |
|---|---|---|---|
| CN | 101661750 | A | 3/2010 |
| CN | 102089808 | A | 6/2011 |
| EP | 2077550 | A1 | 7/2009 |
| EP | 2122615 | B1 | 5/2011 |
| FR | 2010001020 | A2 | 8/2009 |
| JP | H08328597 | A | 12/1996 |
| JP | 2004101720 | A | 4/2004 |
| JP | 2005530205 | A | 10/2005 |
| JP | 2005338637 | A | 12/2005 |
| JP | 2008170554 | A | 7/2008 |
| JP | 2009198612 | A | 9/2009 |
| JP | 6334564 | B2 | 5/2018 |
| RU | 2119727 | C1 | 9/1998 |
| RU | 2006147255 | A | 7/2008 |
| RU | 2361288 | C2 | 7/2009 |
| TW | 201243828 | A | 11/2012 |
| TW | 201243833 | A | 11/2012 |
| WO | 9512920 | A1 | 5/1995 |
| WO | 9738327 | A1 | 10/1997 |
| WO | 9815945 | A1 | 4/1998 |
| WO | 03009273 | A1 | 1/2003 |
| WO | 2008046492 | A1 | 4/2008 |
| WO | 2010003556 | A1 | 1/2010 |
| WO | 2010134963 | A1 | 11/2010 |

OTHER PUBLICATIONS

Daudet, Laurent, "Sparse and Structured Decomposition of Signals with the Molecular Matching Pursuit", IEEE Trans. on Audio, Speech, and Lang. Processingvol. 14, No. 5.

Keiler, Florian, et al., "Survey on Extraction of Sinusoids in Stationary Sounds", Proc. DAFX.

McAulay, Robert J, et al., "Speech Analysis/ Synthesis Based on a Sinusoidal Representation", IEEE Transactions on Acoustics, Speech and Signal Processing, vol. ASSP-34, No. 4, Aug. 1986, pp. 744-754.

Neuendorf, Max, et al., "MPEG Unified Speech and Audio Coding—The ISO/MPEG Standard for High-Efficiency Audio Coding of all Content Types", Audio Engineering Society Convention Paper 8654, Presented at the 132nd Convention, pp. 1-22.

Oger, Marie, et al., "Model-based deadzone optimization for stack-run audio coding with uniform scalar quantization", Acoustics, Speech and Signal Processing, 2008. ICASSP 2008. IEEE International Conference on, IEEE, Piscataway, NJ, USA, pp. 4761-4764.

Zhang, Shu-Hua, et al., {Uploaded in 2 parts} "Optimization of MPEG-2/4 AAC Audio Encoder for Low Complexity", Digital Signal Processing A, vol. 34, No. 4, Dec. 2010, pp. 71-74 and 89.

* cited by examiner

LOW-COMPLEXITY TONALITY-ADAPTIVE AUDIO SIGNAL QUANTIZATION

CROSS-REFERENCE TO RELATED APPLICATIONS

This application is a continuation of U.S. patent application Ser. No. 16/583,119, filed Sep. 25, 2019, which is a continuation of copending U.S. patent application Ser. No. 14/812,465, filed Jul. 29, 2015, which in turn is a continuation of copending International Application No. PCT/EP2014/051624, filed Jan. 28, 2014, which is incorporated herein by reference in its entirety, and additionally claims priority from U.S. Application No. 61/758,191, filed Jan. 29, 2013, which is also incorporated herein by reference in its entirety.

BACKGROUND OF THE INVENTION

The invention relates to digital audio signal processing. More particular the invention relates to audio signal quantization.

In very-low-bit-rate transform coding, the number of bits per frame are generally not sufficient to avoid artifacts in the decoded signal. Musical noise, in particular, can appear in stationary music or noise spectra due to transform lines (bins) being "turned on and off", i.e. quantized to zero or not quantized to zero, at a certain frequency from one frame to the next. Not only does such a coding approach give the decoded signal region a more tonal character than the original signal has (hence the term musical noise), it also does not yield a notable advantage over not coding said spectral region at all and instead applying a bin-replacement technique like the noise filling algorithms in the TCX or FD coding systems employed in xHE-AAC [4]. In fact, the explicit but insufficient coding of regions prone to musical coding noise necessitates bits in the entropy coding stage of the transform coder, which sonically are better spent in other spectral regions, especially at low frequencies where the human auditory system is sensitive.

One way of reducing the occurrence of musical noise in low-bit-rate audio coding is to modify the behavior of the quantizer mapping the input spectral lines to quantization indices so that it adapts to the instantaneous input signal characteristic and bit consumption of the quantized spectrum. More precisely, a dead-zone used during quantization is altered signal-adaptively. Several approaches have been published [5, 6, and references therein]. In [5], the quantizer adaptation is performed on the entire spectrum to be coded. The adapted quantizer therefore behaves identically for all spectral bins of the given frame. Moreover, in case of quantization with the optimal dead-zone $z_{opt}$, 2 bits of side-information has to be transmitted to the decoder, representing a bit-rate and backward-compatibility penalty. In [6], the quantizer is adapted on a per-frequency-band basis, but two quantization attempts are conducted per band, and only the better attempt (according to a certain decision) is used for transmission. This is complex.

SUMMARY

According to an embodiment, an audio encoder for encoding an audio signal so as to produce therefrom an encoded signal, may have: a framing device configured to extract frames from the audio signal; a quantizer configured to map spectral lines of a spectrum signal derived from the frame of the audio signal to quantization indices, wherein the quantizer has a dead-zone, in which the spectral lines are mapped to quantization index zero; and a control device configured to modify the dead-zone; wherein the control device includes a tonality calculating device configured to calculate at least one tonality indicating value for at least one spectrum line or for at least one group of spectral lines, wherein the control device is configured to modify the dead-zone for the at least one spectrum line or the at least one group of spectrum lines depending on the respective tonality indicating value.

Another embodiment may have a system including an encoder and a decoder, wherein the encoder is designed according to the invention.

According to another embodiment, a method for encoding an audio signal so as to produce therefrom an encoded signal may have the steps of: extracting frames from the audio signal; mapping spectral lines of a spectrum signal derived from the frame of the audio signal to quantization indices, wherein a dead-zone is used, in which the input spectral lines are mapped to quantization index zero; and modifying the dead-zone; wherein at least one tonality indicating value for at least one spectrum line or for at least one group of spectral lines is calculated, wherein the dead-zone for the at least one spectrum line or the at least one group of spectrum lines is modified depending on the respective tonality indicating value.

Another embodiment may have a computer program for performing, when running on a computer or a processor, the inventive method.

In one aspect the invention provides an audio encoder for encoding an audio signal so as to produce therefrom an encoded signal, the audio encoder comprising:

a framing device configured to extract frames from the audio signal;

a quantizer configured to map spectral lines of a spectrum signal derived from the frame of the audio signal to quantization indices; wherein the quantizer has a dead-zone, in which the spectral lines are mapped to quantization index zero; and a control device configured to modify the dead-zone;

wherein the control device comprises a tonality calculating device configured to calculate at least one tonality indicating value for at least one spectrum line or for at least one group of spectral lines, wherein the control device is configured to modify the dead-zone for the at least one spectrum line or the at least one group of spectrum lines depending on the respective tonality indicating value.

The framing device may be configured to extract frames from the audio signal by the application of a window function to the audio signal. In signal processing, a window function (also known as an apodization function or tapering function) is a mathematical function that is zero-valued outside of some chosen interval. By the application of the window function to the signal, the signal can be broken into short segments, which are usually called frames.

Quantization, in digital audio signal processing, is the process of mapping a large set of input values to a (countable) smaller set—such as rounding values to some unit of precision. A device or algorithmic function that performs quantization is called a quantizer.

According to the invention a spectrum signal is calculated for the frames of the audio signal. The spectrum signal may contain a spectrum of each of the frames of the audio signal, which is a time-domain signal, wherein each spectrum is a representation of one of the frames in the frequency domain. The frequency spectrum can be generated via a mathematical transform of the signal, and the resulting values are usually presented as amplitude versus frequency.

The dead-zone is a zone used during quantization, wherein spectral lines (frequency bins) or groups of spectral lines (frequency bands) are mapped to zero. The dead-zone has a lower limit, which is usually at an amplitude of zero, and an upper limit, which may vary for different spectral lines or groups of spectral lines.

According to the invention the dead-zone may be modified by a control device. The control device comprises a tonality calculating device which is configured to calculate at least one tonality indicating value for at least one spectrum line or for at least one group of spectrum lines.

The term "tonality" refers to the tonal character of the spectrum signal. In general it may be said that the tonality is high in case that the spectrum comprises predominantly periodic components, which means that the spectrum of a frame comprises dominant peaks. The opposite of a tonal character is a noisy character. In the latter case the spectrum of a frame is more flat.

Furthermore, the control device is configured to modify the dead-zone for the at least one spectrum line or the at least one group of spectrum lines depending on the respective tonality indicating value.

The present invention reveals a quantization scheme with a signal-adaptive dead-zone which

- does not necessitate any side-information, allowing its usage in existing media codecs,
- decides prior to quantization which dead-zone to use per bin or band, saving complexity,
- may determine the per-bin or per-band dead-zone based on band frequency and/and signal tonality.

The invention can be applied in existing coding infrastructure since only the signal quantizer in the encoder is changed; the corresponding decoder will still be able to read the (unaltered) bitstream produced from the encoded signal and decode the output. Unlike in [6] and references therein, the dead-zone for each group of spectral lines or for each spectral line is selected before quantization, so only one quantization operation per group or spectral line is necessitated. Finally, the quantizer decision is not limited to choose between two possible dead-zone values, but an entire range of values. The decision is detailed hereafter. The tonality-adaptive quantization scheme outlined above may be implemented in the transform coded excitation (TCX) path of the LD-USAC encoder, a low-delay variant of xHE-AAC [4].

According to an embodiment of the invention the control device is configured to modify the dead-zone in such way that the dead-zone at one of the spectral lines is larger than the dead-zone is at one of the spectral lines having a larger tonality or in such way that the dead-zone at one of the groups of spectral lines is larger than the dead-zone is at one of the groups of spectral lines having a larger tonality. By this features non-tonal spectral regions will tend to be quantized to zero, which means that the quantity of the data may be reduced.

According to an embodiment of the invention the control device comprises a power spectrum calculating device configured to calculate a power spectrum of the frame of the audio signal, wherein the power spectrum comprises power values for spectral lines or groups of spectral lines, wherein the tonality calculating device is configured to calculate the at least one tonality indicating value depending on the power spectrum. By calculating the tonality indicating value based on the power spectrum the computational complexity remains quite low.

According to an embodiment of the invention the tonality indicating value for one of the spectral lines is based on a comparison of the power value for the respective spectral line and the sum of a predefined number of its surrounding power values of the power spectrum, or wherein the tonality indicating value for one of the groups of the spectral lines is based on a comparison of the power value for the respective group of spectral lines and the sum of a predefined number of its surrounding power values of the power spectrum. By comparing a power value with its neighboring power values peak areas or flat areas of the power spectrum may be easily identified so that the tonality indicating value may be calculated in an easy way.

According to an embodiment of the invention the tonality indicating value for one of the spectral lines is based on the tonality indicating value of the spectral line of a preceding frame of the audio signal, or wherein the tonality indicating value for one of the groups of the spectral lines is based on the tonality indicating value of the group of spectral lines for a preceding frame of the audio signal. By these features the dead-zone will be modified over time in a smooth manner.

According to an embodiment of the invention the tonality indicating value is calculated by a formula $$T_{k,i} = f\left(\frac{P_{k-7,i} + \ldots + P_{k-1,i} + P_{k+1,i} + \ldots + P_{k+7,i}}{P_{k,i}}, \frac{P_{k-7,i-1} + \ldots + P_{k-1,i-1} + P_{k+1,i-1} + \ldots + P_{k+7,i-1}}{P_{k,i-1}}\right),$$

wherein i is an index indicating a specific frame of the audio signal, k is an index indicating a specific spectral line, $P_{k,i}$ is the power value of the k-th spectral line of the i-th frame, or wherein the tonality indicating value is calculated by a formula $$T_{m,i} = f\left(\frac{P_{m-7,i} + \ldots + P_{m-1,i} + P_{m+1,i} + \ldots + P_{m+7,i}}{P_{m,i}}, \frac{P_{m-7,i-1} + \ldots + P_{m-1,i-1} + P_{m+1,i-1} + \ldots + P_{m+7,i-1}}{P_{m,i-1}}\right),$$

wherein i is an index indicating a specific frame of the audio signal, m is an index indicating a specific group of spectral lines, $P_{m,i}$ is the power value of the m-th group of spectral lines of the i-th frame. As one will note from the formula the tonality indicating value is calculated from power value of the i-th frame, which is the current frame, and from the i-1-th frame, which is the preceding frame. The formula may be changed by omitting the dependency from the i-1-th frame. Here the sum of 7 left and 7 right neighboring power values of the k-th power value is calculated and divided by the respective power value. Using this formula a low tonality indicating value indicates a high tonality.

According to an embodiment of the invention the audio encoder comprises a start frequency calculating device configured to calculate a start frequency for modifying the dead-zone, wherein the dead-zone is only modified for spectral lines representing a frequency higher than or equal to the start frequency. This means that the dead-zone is fixed for low frequencies and variable for higher frequencies. These features lead to better audio quality as the human auditory system is more sensitive at low frequencies.

According to an embodiment of the invention the start frequency calculating device is configured to calculate the start frequency based on a sample rate of the audio signal and/or based on a maximum bit-rate foreseen for a bitstream produced from the encoded signal. By these features will audio quality may be optimized.

According to an embodiment of the invention the audio encoder comprises a modified discrete cosine transform calculating device configured to calculate a modified discrete cosine transform from the frame of the audio signal and a modified discrete sine transform calculating device configured to calculate a modified discrete sine transform from the frame of the audio signal, wherein the power spectrum calculating device is configured to calculate the power spectrum based on the modified discrete cosine transform and on the modified discrete sine transform. The modified discrete cosine transform has to be calculated anyway for the purpose of encoding the audio signal. Hence, only the modified discrete sine transform as to be calculated additionally for the purpose of tonality-adaptive quantization. Therefore, complexity may be reduced. However, other transforms may be used such as discrete Fourier transform or odd discrete Fourier transform.

According to an embodiment of the invention the power spectrum calculating device is configured to calculate the power values according to the formula $P_{k,i}=(MDCT_{k,i})^2(MDST_{k,i})^2$, wherein i is an index indicating a specific frame of the audio signal, k is an index indicating a specific spectral line, $MDCT_{k,i}$ is the value of the modified discrete cosine transform at the k-th spectral line of the i-th frame, $MDST_{k,i}$ is the value of the modified discrete sine transform at the k-th spectral line of the i-th frame, and $P_{k,i}$ is the power value of the k-th spectral line of the i-th frame. The formula above allows calculating the power values in an easy way.

According to an embodiment of the invention the audio encoder comprises a spectrum signal calculating device configured to produce the spectrum signal, wherein the spectrum signal calculating device comprises an amplitude setting device configured to set amplitudes of the spectral lines of the spectrum signal in such way that an energy loss due to a modification of the dead-zone is compensated. By these features the quantization may be done in an energy preserving way According to an embodiment of the invention the amplitude setting device is configured to set the amplitudes of the spectrum signal depending on a modification of the dead-zone at the respective spectral line. For example spectral lines, for which the dead-zone is enlarged, may be slightly amplified for this purpose.

According to an embodiment of the invention the spectrum signal calculating device comprises a normalizing device. By this feature the subsequent quantization step may be done in an easy way.

According to an embodiment of the invention the modified discrete cosine transform from the frame of the audio signal calculated by the modified discrete cosine transform calculating device is fed to the spectrum signal calculating device. By these feature the modified discrete cosine transform is used for the purpose of quantization adaption and for the purpose of calculating the encoded signal.

In one aspect the invention provides a system comprising an encoder and a decoder, wherein the encoder is designed according to the invention.

In one aspect the invention provides a method for encoding an audio signal so as to produce therefrom an encoded signal, the method comprising the steps:

extracting frames from the audio signal;

mapping spectral lines of a spectrum signal derived from the frame of the audio signal to quantization indices; wherein a dead-zone is used, in which the input spectral lines are mapped to zero; and modifying the dead-zone;

wherein at least one tonality indicating value for at least one spectrum line or for at least one group of spectral lines is calculated, wherein the dead-zone for the at least one spectrum line or the at least one group of spectrum lines is modified depending on the respective tonality indicating value.

In one aspect the invention provides a computer program for performing, when running on a computer or a processor, the method according to the invention.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
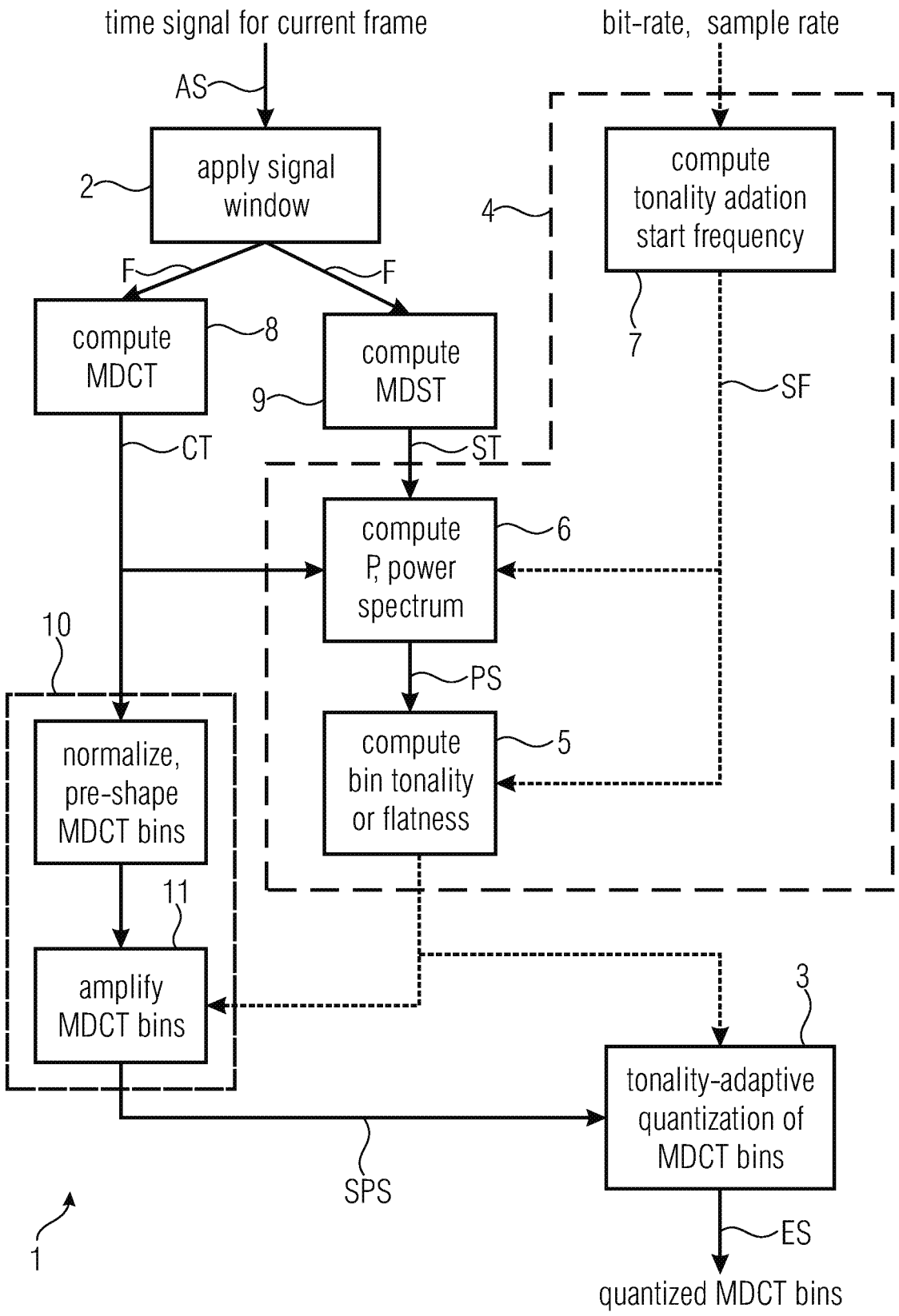
FIG. 1 illustrates an embodiment of an encoder according to the invention and FIG. 2 illustrates the working principle of an encoder according to the invention.

FIG. 1 depicts an audio encoder 1 for encoding an audio signal AS so as to produce therefrom an encoded signal ES according to the invention. The audio encoder 1 comprises:

a framing device 2 configured to extract frames F from the audio signal AS;

a quantizer 3 configured to map spectral lines $SL_{1-32}$ (see FIG. 2) of a spectrum signal SPS derived from the frame F of the audio signal AS to quantization indices $I_0$, $I_1$; wherein the quantizer 3 has a dead-zone DZ (see FIG. 2), in which the spectral lines $SL_{1-32}$ are mapped to quantization index zero $I_0$; and a control device 4 configured to modify the dead-zone DZ;

wherein the control device 4 comprises a tonality calculating device 5 configured to calculate at least one tonality indicating value $TI_{5-32}$ for at least one spectrum line $SL_{1-32}$ or for at least one group of spectral lines $SL_{1-32}$, wherein the control device 4 is configured to modify the dead-zone DZ for the at least one spectrum line $SL_{1-32}$ or the at least one group of spectrum lines $SL_{1-32}$ depending on the respective tonality indicating value $TI_{5-32}$.

The framing device 2 may be configured to extract frames F from the audio signal AS by the application of a window function to the audio signal AS. In signal processing, a window function (also known as an apodization function or tapering function) is a mathematical function that is zero-valued outside of some chosen interval. By the application of the window function to the signal AS, the signal AS can be broken into short segments, which are usually called frames F.

Quantization, in digital audio signal processing, is the process of mapping a large set of input values to a (countable) smaller set—such as rounding values to some unit of precision. A device or algorithmic function that performs quantization is called a quantizer.

According to the invention a spectrum signal SPS is calculated for the frames F of the audio signal AS. The spectrum signal SPS may contain a spectrum of each of the frames F of the audio signal AS, which is a time-domain signal, wherein each spectrum is a representation of one of the frames F in the frequency domain. The frequency spectrum can be generated via a mathematical transform of the signal AS, and the resulting values are usually presented as amplitude versus frequency.

The dead-zone DZ is a zone used during quantization, wherein spectral lines $SL_{1-32}$ (frequency bins) or groups of spectral lines $SL_{1-32}$ (frequency bands) are mapped to quantization index zero. The dead-zone DZ has a lower limit, which is usually at an amplitude of zero, and an upper limit, which may vary for different spectral lines $SL_{1-32}$ or groups of spectral lines $SL_{1-32}$.

According to the invention the dead-zone DZ is may be modified by a control device 4. The control device 4 comprises a tonality calculating device 5 which is configured to calculate at least one tonality indicating value $TI_{5-32}$ for at least one spectrum line $SL_{1-32}$ or for at least one group spectrum lines. $SL_{1-32}$ The term "tonality" refers to the tonal character of the spectrum signal SPS. In general it may be said that the tonality is high in case that the spectrum or a part thereof comprises predominantly periodic components, which means that the spectrum or the part thereof of a frame F comprises dominant peaks. The opposite of a tonal character is a noisy character. In the latter case the spectrum or the part thereof of a frame F is more flat.

Furthermore, the control device 4 is configured to modify the dead-zone DZ for the at least one spectrum line $SL_{1-32}$ or the at least one group of spectrum lines $SL_{1-32}$ depending on the respective tonality indicating value $TI_{5-32}$.

The present invention reveals a quantization scheme with a signal-adaptive dead-zone DZ which

- does not necessitate any side-information, allowing its usage in existing media codecs,
- decides prior to quantization which dead-zone DZ to use per bin or band, saving complexity,
- may determine the per-bin or per-band dead-zone DZ based on band frequency and/or signal tonality.

The invention can be applied in existing coding infrastructure since only the signal quantizer 3 in the encoder 1 is changed; the corresponding decoder will still be able to read the (unaltered) bitstream produced from the encoded signal and decode the output. Unlike in [6] and references therein, the dead-zone DZ for each group of spectral lines $SL_{1-32}$ or for each spectral line $SL_{1-32}$ is selected before quantization, so only one quantization operation per group or spectral line $SL_{1-32}$ is necessitated. Finally, the quantizer decision is not limited to choose between two possible dead-zone values, but an entire range of values. The tonality-adaptive quantization scheme outlined above may be implemented in the transform coded excitation (TCX) path of the LD-USAC encoder, a low-delay variant of xHE-AAC [4].

According to an embodiment of the invention the control device 4 is configured to modify the dead-zone DZ in such way that the dead-zone DZ at one of the spectral lines $SL_{1-32}$ is larger than the dead-zone DZ is at one of the spectral lines $SL_{1-32}$ having a larger tonality or in such way that the dead-zone DZ at one of the groups of spectral lines $SL_{1-32}$ is larger than the dead-zone DZ is at one of the groups of spectral lines $SL_{1-32}$ having a larger tonality. By this features non-tonal spectral regions will tend to be quantized to zero, which means that the quantity of the data may be reduced.

According to an embodiment of the invention the control device 4 comprises a power spectrum calculating device 6 configured to calculate a power spectrum PS (see also FIG. 2) of the frame F of the audio signal AS, wherein the power spectrum PS comprises power values $PS_{5-32}$ for spectral lines $SL_{1-32}$ or groups of spectral lines $SL_{1-32}$, wherein the tonality calculating device 5 is configured to calculate the at least one tonality indicating value $TI_{5-32}$ depending on the power spectrum PS. By calculating the tonality indicating $TI_{5-32}$ value based on the power spectrum PS the computational complexity re-mains quite low. Furthermore, the accuracy may be enhanced.

According to an embodiment of the invention the tonality indicating value $TI_{5-32}$ for one of the spectral lines $SL_{1-32}$ is based on a comparison of the power value $PS_{5-32}$ for the respective spectral line $SL_{1-32}$ and the sum of a predefined number of its surrounding power values $PS_{5-32}$ of the power spectrum PS, or wherein the tonality indicating value for one of the groups of the spectral lines $SL_{1-32}$ is based on a comparison of the power value $PS_{5-32}$ for the respective group of spectral lines and the sum of a predefined number of its surrounding power values $PS_{5-32}$ of the power spectrum. By comparing a power value $PS_{5-32}$ with its neighboring power values $PS_{5-32}$ peak areas or flat areas of the power spectrum SP may be easily identified so that the tonality indicating value $TI_{5-32}$ may be calculated in an easy way.

According to an embodiment of the invention the tonality indicating value $TI_{5-32}$ for one of the spectral lines $SL_{1-32}$ is based on the tonality indicating value $TI_{5-32}$ of the spectral line $SL_{1-32}$ of a preceding frame F of the audio signal AS, or wherein the tonality indicating value $TI_{5-32}$ for one of the groups of the spectral lines $SL_{1-32}$ is based on the tonality indicating value $TI_{5-32}$ of the group of spectral lines $SL_{1-32}$ for a preceding frame F of the audio signal AS. By these features the dead-zone DZ will be modified over time in a smooth manner.

According to an embodiment of the invention the tonality indicating value $TI_{5-32}$ is calculated by a formula $$T_{k,i} = f\left(\frac{P_{k-7,i} + \ldots + P_{k-1,i} + P_{k+1,i} + \ldots + P_{k+7,i}}{P_{k,i}}, \frac{P_{k-7,i-1} + \ldots + P_{k-1,i-1} + P_{k+1,i-1} + \ldots + P_{k+7,i-1}}{P_{k,i-1}}\right),$$

wherein i is an index indicating a specific frame F of the audio signal AS, k is an index indicating a specific spectral line $SL_{1-32}$, $P_{k,i}$ is the power value $PS_{5-32}$ of the k-th spectral line $SL_{1-32}$ of the i-th frame, or wherein the tonality indicating value $TI_{5-32}$ is calculated by a formula $$T_{m,i} = f\left(\frac{P_{m-7,i} + \ldots + P_{m-1,i} + P_{m+1,i} + \ldots + P_{m+7,i}}{P_{m,i}}, \frac{P_{m-7,i-1} + \ldots + P_{m-1,i-1} + P_{m+1,i-1} + \ldots + P_{m+7,i-1}}{P_{m,i-1}}\right),$$

wherein i is an index indicating a specific frame F of the audio signal AS, m is an index indicating a specific group of spectral lines $SL_{1-32}$, $P_{m,i}$ is the power value $PS_{5-32}$ of the m-th group of spectral lines $SL_{1-32}$ of the i-th frame. As one will note from the formula the tonality indicating value $TI_{5-32}$ is calculated from power value $PS_{5-32}$ of the i-th frame, which is the current frame F, and from the i-1-th frame F, which is the preceding frame F. The formula may be changed by omitting the dependency from the i-1-th frame F. Here the sum of the 7 left and 7 right neighboring power values $PS_{5-32}$ of the k-th power value $PS_{5-32}$ of a certain spectral line $SL_{1-32}$ or the m-th power value of group of spectral lines $SL_{1-32}$ is calculated and divided by the respective power value $PS_{5-32}$. Using this formula a low tonality indicating value $TI_{5-32}$ indicates a high tonality.

According to an embodiment of the invention the audio encoder 1 comprises a start frequency calculating device 7 configured to calculate a start frequency SF for modifying the dead-zone DZ, wherein the dead-zone DZ is only modified for spectral lines $SL_{5-32}$ representing a frequency higher than or equal to the start frequency SF. This means that the dead-zone DZ is fixed for low frequencies and variable for higher frequencies. These features lead to better audio quality as the human auditory system is more sensitive at low frequencies.

According to an embodiment of the invention the start frequency calculating device 7 is configured to calculate the start frequency SF based on a sample rate of the audio signal AS and/or based on a maximum bit-rate foreseen for a bitstream produced from the encoded signal ES. By these features will audio quality may be optimized.

According to an embodiment of the invention the audio encoder 1 comprises a modified discrete cosine transform calculating device 8 configured to calculate a modified discrete cosine transform CT from the frame F of the audio signal AS and a modified discrete sine transform calculating device 9 configured to calculate a modified discrete sine transform ST from the frame F of the audio signal AS, wherein the power spectrum calculating device 6 is configured to calculate the power spectrum PS based on the modified discrete cosine transform CT and on the modified discrete sine transform ST. The modified discrete cosine transform CT has to be calculated anyway in many cases for the purpose of encoding the audio signal AS. Hence, only the modified discrete sine transform ST has to be calculated additionally for the purpose of tonality-adaptive quantization. Therefore, complexity may be reduced. However, other transforms may be used such as discrete Fourier transform or odd discrete Fourier transform.

According to an embodiment of the invention the power spectrum calculating device 6 is configured to calculate the power values according to the formula $P_{k,i}=(MDCT_{k,i})^2+(MDST_{k,i})^2$, wherein i is an index indicating a specific frame F of the audio signal, k is an index indicating a specific spectral line $SL_{1-32}$, $MDCT_{k,i}$ is the value of the modified discrete cosine transform CT at the k-th spectral line of the i-th frame, $MDST_{k,i}$ is the value of the modified discrete sine transform ST at the k-th spectral line of the i-th frame, and $P_{k,i}$ is the power value $PS_{5-32}$ of the k-th spectral line of the i-th frame. The formula above allows to calculate the power values $PS_{5-32}$ in an easy way.

According to an embodiment of the invention the audio encoder 1 comprises a spectrum signal calculating device 10 configured to produce the spectrum signal SPS, wherein the spectrum signal calculating device 10 comprises an amplitude setting device 11 configured to set amplitudes of the spectral lines $SL_{1-32}$ of the spectrum signal SPS in such way that an energy loss due to a modification of the dead-zone DZ is compensated. By these features the quantization may be done in an energy preserving way According to an embodiment of the invention the amplitude setting device 11 is configured to set the amplitudes of the spectrum signal SPS depending on a modification of the dead-zone DZ at the respective spectral line $SL_{1-32}$. For example spectral lines $SL_{1-32}$, for which the dead-zone DZ is enlarged, may be slightly amplified for this purpose.

According to an embodiment of the invention the spectrum signal calculating device 10 comprises a normalizing device 12. By this feature the subsequent quantization step may be done in an easy way.

According to an embodiment of the invention the modified discrete cosine transform CT from the frame F of the audio signal AS calculated by the modified discrete cosine transform calculating device 8 is fed to the spectrum signal calculating device 10. By these feature the modified discrete cosine transform CT is used for the purpose of quantization adaption and for the purpose of calculating the encoded signal ES.

FIG. 1 depicts the flow of data and control information in the inventive adaptive encoder 1. It should be reiterated that non-tonal spectral regions above a certain frequency SF will tend to be quantized to zero quite extensively at low bit-rates. This, however, is intended: noise insertion applied on zero-bins in the decoder will sufficiently reconstruct the noise-like spectra, and the zero-quantization will save bits, which can be used to quantize low-frequency bins more finely.

Figure 2:
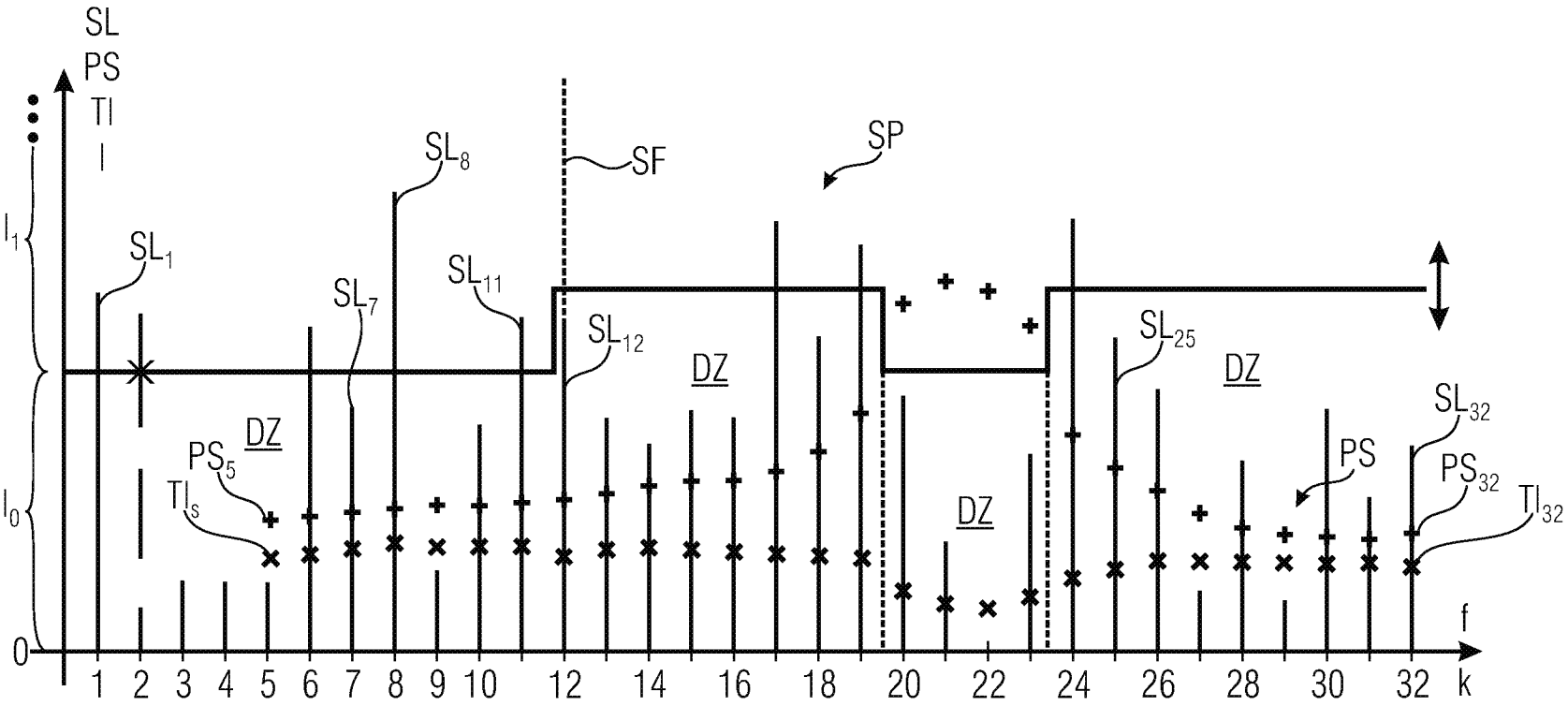

FIG. 2 illustrates the working principle of an encoder according to the invention. Herein, the dead-zone DZ of an audio encoder 1 according to the invention, the power spectrum PS with its power values $PS_{5-32}$ of a frame F of an audio signal AS, the tonality indicating values $TI_{5-32}$ and the spectral lines $SL_{1-32}$ of the spectrum SP are shown in a common coordinate system, wherein the x-axis denotes a frequency and the y-axis denotes amplitudes. It has to be noted that mapping indices larger than 1 are not shown in FIG. 2 for simplification.

Below a start frequency SF, which has been calculated by the start frequency calculating device 7, the dead-zone has a fixed size. In the example the spectral line $SL_1$ ends outside of the dead-zone so that it will be mapped to the index one $I_1$, whereas the spectral line $SL_7$ ends within the dead-zone DZ so that it can be mapped to index 0 $I_0$. However, beginning with the start frequency SF and going to higher frequencies, the size of the dead-zone DZ may be modified by the control device 4. For that purpose, the power values $PS_{5-32}$ are calculated as described above. Furthermore, the tonality indicating values $TI_{5-32}$ are calculated from the power values $PS_{5-32}$.

In the area from k=20 to k=23 the power spectrum PS has a peak which results in low tonality indicating values $TI_{20-23}$ which indicate a high tonality. In the other areas above the start frequency SF for power spectrum PS is more flat so that the tonality indicating values $TI_{12-19}$ and $TI_{24-32}$ are comparably higher, which indicates a lower tonality in their respective areas. As a result the dead-zone DZ is enlarged in the area from k=12 to k=19 and in the area from k=24 to k=32. This enlargement of the dead-zone DZ results in that, for example, that spectral line $SL_{12}$ and spectral line $SL_{25}$, which without tonality adaptive quantization would have been mapped to index one are now mapped to index zero. This zero-quantization reduces the quantity of the data to be transmitted to the decoder.

In an implementation of the invention, the encoder operation is summarized as follows:

1. During the time-to-frequency transformation step, both an MDCT (cosine part) and an MDST (sine part) are computed from the windowed input signal for the given frame.
2. The MDCT of the input frame is used for quantization, coding, and transmission. The MDST is further utilized to compute a per-bin power spectrum $Pk=MDCTk^2+MDSTk^2$.
3. With Pk a per-coding-band, or advantageously per-bin, tonality or spectral flatness measure is calculated. Several methods to achieve this are documented in the literature [1,2,3]. Advantageously, a low-complexity version with only few operations per bin is employed. In the present case, a comparison between Pk and the sum of its surrounding Pk−7 . . . k+7 is made and enhanced with a hysteresis similar to the birth/death tracker described in [3]. Moreover, bins below a certain bit-rate-dependent frequency are regarded tonal.

4. As an optional step, the tonality or flatness measure can be utilized to perform a slight amplification of the spectrum prior to quantization in order to compensate for energy loss due to a large quantizer dead-zone. More precisely, bins for which a large quantizer dead-zone is applied are amplified a bit, whereas bins for which a normal or close to-normal dead-zone (i.e. one that tends to preserve energy) is used are not modified.
5. The tonality or flatness measure of step 3 now controls the choice of dead-zone used for quantizing each frequency bin. Bins determined as having a high tonality, meaning low values of Pk−7 . . . k+7/Pk, are quantized with a default (i.e. roughly energy preserving) dead-zone, and bins with low tonality are quantized with a new enlarged dead-zone. A low-tonality bin thus tends to be quantized to zero more often than a high-tonality bin. Optionally, the size of a bin's dead-zone can be defined as a continuous function of bin tonality, with a range between the default (smallest) and a maximum dead-zone size.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

Depending on certain implementation requirements, embodiments of the invention can be implemented in hardware or in software. The implementation can be performed using a non-transitory storage medium such as a digital storage medium, for example a floppy disc, a DVD, a Blu-Ray, a CD, a ROM, a PROM, and EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may, for example, be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive method is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the invention method is, therefore, a data stream or a sequence of signals representing the computer program for performing one of the methods described herein. The data stream or the sequence of signals may, for example, be configured to be transferred via a data communication connection, for example, via the internet.

A further embodiment comprises a processing means, for example, a computer or a programmable logic device, configured to, or adapted to, perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example, a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[1] L. Daudet, "Sparse and Structured Decomposition of Signals with the Molecular Matching Pursuit," IEEE Trans. on Audio, Speech, and Lang. Processing, Vol. 14, No. 5, September 2006.

[2] F. Keiler, "Survey on Extraction of Sinusoids in Stationary Sounds," in Proc. DAFX, 2002.

[3] R.J. McAulay and T. F. Quatieri, "Speech Analysis/Synthesis Based on a Sinusoidal Representation," IEEE Trans. Acoustics, Speech, and Sig. Processing, Vol. 34, No. 4, August 1986.

[4] M. Neuendorf et al., "MPEG Unified Speech and Audio Coding—The ISO/MPEG Standard for High-Efficiency Audio Coding of All Content Types," in Proc. 132nd Convention of the AES, Budapest, Hungary, April 2012. Also to appear in the Journal of the AES, 2013.

[5] M. Oger et al., "Model-Based Deadzone Optimization for Stack-Run Audio Coding with Uniform Scalar Quantization," in Proc. ICASSP 2008, Las Vegas, USA, April 2008.

[6] M. Schug, EP2122615, "Apparatus and method for encoding an information signal", 2007.

The invention claimed is:

1. Audio encoder for encoding an audio signal so as to produce therefrom an encoded signal, the audio encoder comprising:

a framing device configured to extract frames from the audio signal;

a quantizer configured to map spectral lines of a spectrum signal derived from the frame of the audio signal to quantization indices, wherein the quantizer comprises a dead-zone, in which the spectral lines are mapped to quantization index zero; and a control device configured to modify the dead-zone;

wherein the control device comprises a tonality calculating device configured to calculate at least one tonality indicating value for at least one spectrum line or for at least one group of spectral lines, wherein the control device is configured to modify the dead-zone for the at least one spectrum line or the at least one group of spectrum lines depending on the respective tonality indicating value in such way that the dead-zone for the at least one spectrum line or the at least one group of spectral lines is selected before mapping the at least one spectrum line or the at least one group of spectral lines to the quantization indices.

2. Audio encoder according to claim 1, wherein the control device is configured to modify the dead-zone in such way that the dead-zone at one of the spectral lines is larger than the dead-zone is at one of the spectral lines comprising a larger tonality or in such way that the dead-zone at one of the groups of spectral lines is larger than the dead-zone is at one of the groups of spectral lines comprising a larger tonality.

3. Audio encoder according to claim 1, wherein the control device comprises a power spectrum calculating device configured to calculate a power spectrum of the frame of the audio signal, wherein the power spectrum comprises power values for spectral lines or groups of spectral lines, wherein the tonality calculating device is configured to calculate the at least one tonality indicating value depending on the power spectrum.

4. Audio encoder according to claim 3, wherein the tonality indicating value for one of the spectral lines is based on a comparison of the power value for the respective spectral line and the sum of a predefined number of its surrounding power values of the power spectrum, or wherein the tonality indicating value for one of the groups of the spectral lines is based on a comparison of the power value for the respective group of spectral lines and the sum of a predefined number of its surrounding power values of the power spectrum.

5. Audio encoder according to claim 1, wherein the tonality indicating value for one of the spectral lines is based on the tonality indicating value of the spectral line of a preceding frame of the audio signal, or wherein the tonality indicating value for one of the groups of the spectral lines is based on the tonality indicating value of the group of spectral lines for a preceding frame of the audio signal.

6. Audio encoder according to claim 3, wherein the tonality indicating value is calculated by a formula $$T_{k,i} = f\left(\frac{P_{k-7,i} + \ldots + P_{k-1,i} + P_{k+1,i} + \ldots + P_{k+7,i}}{P_{k,i}}, \frac{P_{k-7,i-1} + \ldots + P_{k-1,i-1} + P_{k+1,i-1} + \ldots + P_{k+7,i-1}}{P_{k,i-1}}\right),$$

wherein i is an index indicating a specific frame of the audio signal, k is an index indicating a specific spectral line, $T_{k,i}$ is the tonality indicating value of the k-th spectral line of the i-th frame, $P_{k,i}$ is the power value of the k-th spectral line of the i-th frame, or wherein the tonality indicating value is calculated by a formula $$T_{m,i} = f\left(\frac{P_{m-7,i} + \ldots + P_{m-1,i} + P_{m+1,i} + \ldots + P_{m+7,i}}{P_{m,i}}, \frac{P_{m-7,i-1} + \ldots + P_{m-1,i-1} + P_{m+1,i-1} + \ldots + P_{m+7,i-1}}{P_{m,i-1}}\right),$$

wherein i is an index indicating a specific frame of the audio signal, m is an index indicating a specific group of spectral lines, $P_{m,i}$ is the power value of the m-th group of spectral lines of the i-th frame.

7. Audio encoder according to claim 1, wherein the audio encoder comprises a start frequency calculating device configured to calculate a start frequency for modifying the dead-zone, wherein the dead-zone is only modified for spectral lines representing a frequency higher than or equal to the start frequency.

8. Audio encoder according to claim 7, wherein the start frequency calculating device is configured to calculate the start frequency based on a sample rate of the audio signal and/or based on a maximum bit-rate foreseen for a bitstream produced from the encoded signal.

9. Audio encoder according to claim 3, wherein the audio encoder comprises a modified discrete cosine transform calculating device configured to calculate a modified discrete cosine transform from the frame of the audio signal and a modified discrete sine transform calculating device configured to calculate a modified discrete sine transform from the frame of the audio signal, wherein the power spectrum calculating device is configured to calculate the power spectrum based on the modified discrete cosine transform and on the modified discrete sine transform.

10. Audio encoder according to claim 3, wherein the power spectrum calculating device is configured to calculate the power values according to a formula $P_{k,i}=(MDCT_{k,i})^2+(MDST_{k,i})^2$, wherein i is an index indicating a specific frame of the audio signal, k is an index indicating a specific spectral line, $MDCT_{k,i}$ is the value of the modified discrete cosine transform at the k-th spectral line of the i-th frame, $MDST_{k,i}$ is the value of the modified discrete sine transform at the k-th spectral line of the i-th frame, and $P_{k,i}$ is the power value of the k-th spectral line of the i-th frame.

11. Audio encoder according to claim 1, wherein the audio encoder comprises a spectrum signal calculating device configured to produce the spectrum signal, wherein the spectrum signal calculating device comprises an amplitude setting device configured to set amplitudes of the spectral lines of the spectrum signal in such way that an energy loss due to a modification of the dead-zone is compensated.

12. Audio encoder according to claim 11, wherein the amplitude setting device is configured to set the amplitudes of the spectrum signal depending on a modification of the dead-zone at the respective spectral line.

13. Audio encoder according to claim 11, wherein the spectrum signal calculating device comprises a normalizing device.

14. Audio encoder according to claim 11, wherein the modified discrete cosine transform from the frame of the audio signal calculated by the modified discrete cosine transform calculating device is fed to the spectrum signal calculating device.

15. A system comprising an encoder and a decoder, wherein the encoder is designed according to claim 1.

16. Method for encoding an audio signal so as to produce therefrom an encoded signal, the method comprising:

extracting frames from the audio signal;

mapping spectral lines of a spectrum signal derived from the frame of the audio signal to quantization indices, wherein a dead-zone is used, in which the spectral lines are mapped to quantization index zero; and modifying the dead-zone;

wherein at least one tonality indicating value for at least one spectrum line or for at least one group of spectral lines is calculated, wherein the dead-zone for the at least one spectrum line or the at least one group of spectrum lines is modified depending on the respective tonality indicating value in such way that the dead-zone for the at least one spectrum line or the at least one group of spectral lines is selected before mapping the at least one spectrum line or the at least one group of spectral lines to the quantization indices.

17. A non-transitory computer-readable storage medium storing a computer program for performing, when running on a computer or a processor, the method of claim 16.

* * * * *